United States Patent [19]

Hanson

[11] Patent Number: 4,463,456

[45] Date of Patent: Aug. 7, 1984

[54] PROTECTIVE HELMET

[75] Inventor: George N. Hanson, New York, N.Y.

[73] Assignee: Eastern Safety Equipment Co., Inc., Long Island City, N.Y.

[21] Appl. No.: 416,199

[22] Filed: Sep. 9, 1982

[51] Int. Cl.[3] ..... A42B 3/02

[52] U.S. Cl. ..... 2/416

[58] Field of Search ..... 2/416, 418, 419, 420, 2/411, 6, 417, 310, 326, 327, 44, 45

[56] References Cited

U.S. PATENT DOCUMENTS

| | | | |
|---|---|---|---|
| 2,185,717 | 1/1940 | Wisman | 2/416 |
| 2,858,538 | 11/1958 | Simpson | 2/416 |
| 2,870,445 | 1/1959 | Fisher | 2/416 |
| 3,516,092 | 6/1970 | Raschke | 2/416 |
| 3,797,039 | 3/1974 | Penberthy | 2/416 |
| 4,055,860 | 11/1977 | King | 2/416 |
| 4,293,960 | 10/1981 | Palmaer | 2/416 |

*Primary Examiner*—Werner H. Schroeder
*Assistant Examiner*—J. L. Kravitz
*Attorney, Agent, or Firm*—Paul J. Sutton

[57] ABSTRACT

The present invention teaches a protective helmet including an improved interior head-support suspension assembly which separates the helmet shell from the head of the user during occurrences of normal and abnormal vertical and lateral forces.

7 Claims, 7 Drawing Figures

PROTECTIVE HELMET

The present invention relates to safety, or protective, helmets and more particularly to an improved interior suspension assembly for hard-shelled helmets.

The standard protective helmet of the type used, for example, by construction workers comprises two basic components, a hard, plastic shell and a dihedral, or interior suspension assembly, also of plastic construction, which is hung from the shell. The suspension assembly in turn includes a suspension body which is connected to four flexible tabs mounted around the interior rim of the shell and a nylon suspension webbing, or strap, which is also connected to the flexible tabs. The suspension body extends below the rim of the shell and fits around the forehead and nape of the neck of the wearer and serves primarily in keeping the shell in place on the head of the wearer and from slipping during normal use. The nylon strap is fitted to each of the tabs so as to extend diagonally from each front tab to each rear tab. Two separate straps are used, one strap for each diagonal extension. Each strap is then joined to its rim end or some other selected section. The flexible tabs in normal use are adapted to slide into four tab recesses that extend into the helmet shell. Two parallel slots adapted to receive the strap are formed in such tabs. The nylon strap is commonly ¾ or ½ inch across the flat, and each of the slots are adapted to receive the particular strap. Because the tab has a suspension mounting hole at its end, the strap is run under the tab into the first slot where it emerges and runs over the tab to the second slot, from where it runs under the tab again and then extends diagonally across the helmet to the opposite tab where it is mounted in a similar manner. At its opposite end the strap is connected to itself. The diagonally crossed straps are secured tightly enough to keep the shell from pressing against the head of the user during normal use or from striking against the head in an abnormal occurrence. The straps are also flexibly mounted to enable the suspension to respond to vertical pressure upon the top of the shell.

The protective helmet known in the art, despite rendering great service in protecting the heads of workmen, has some drawbacks that are worth pointing out. One drawback is that the straps do not give much support in protecting the head of the wearer in lateral directions, that is, from the sides of the shell. Protection mainly comes from the suspension body, which is not particularly designed to give such lateral protection. Also, the helmet known in the art as described is fitted with two separate straps, each joined to itself. This increases the odds in relation to a strap breaking upon an impact against the shell. Also, in the event of an impact, most of the pressure is taken upon only the two diagonal straps, which are in fact the real protection against impact. Finally, in normal wear, the worker will experience a slight lateral shift of the shell because of the lack of good side support. The present invention contemplates the elimination of most of all of these limitations and disadvantages of the present state of the art by providing a novel suspension assembly as related to the webbing, or straps, for the protective helmet.

Accordingly, it is an object of my invention to provide an improved protective helmet that gives both top and lateral strap support to the wearer.

It is a further object of my invention to provide protective helmet with straps that connect to flexible tabs both diagonally across the top of the head of the wearer and also along the sides of the head of the wearer.

It is a further object of my invention to provide a novel flexible tab that has crossed slots that are adapted to receive a nylon strap.

It is a further object of my invention to provide flexible tabs with crossed slots adapted to receive the diagonal of a strap and divert it via the crossed slots to a side strap that extends between the front or rear tab of the helmet.

It is a further object of my invention to provide a single strap support for a helmet that extends both diagonally across the top and along the sides of the shell and that connects at only a single point, thus reducing the chances for breaking as compared to the prior art.

It is yet another object of this invention to provide a protective helmet that gives lateral, or side, support to a wearer thus adding to the comfort of the wearer.

It is still a further object of my invention to provide a strap support for the shell that spreads any impact against the shell over a wider strap area than the single crossed webbing presently known in the art.

The present invention fulfills the above objects and overcomes the limitations and disadvantages of prior art by providing a novel improved suspension assembly which includes flexible front and rear tabs mounted in the shell recess that has a transverse slot and two crossed perpendicularly crossed slots each adapted to receive a suspension strap. The crossed slots are each positioned at approximately 45 degrees to the transverse slot. A single strap is slidably mounted through the tabs and extends diagonally between the front and rear tabs over two equal distances and over two equal side distances. The diagonal straps are in spaced relationship from the top wall portion of the shell; and the side straps are in spaced relationship from the side wall portions. The diagonal straps are disposed nearer to the top wall of the shell than the side wall straps. The wearer of the helmet thus has not only vertical protection but added side protection against impact. In addition, a lateral stability is added to the shell that increases the comfort of wearing the helmet.

The invention will be more clearly understood from the following description of specific embodiments of the invention together with the accompanying drawings, wherein similar reference characters denote similar elements throughout the several views, and in which.

Figure 1:
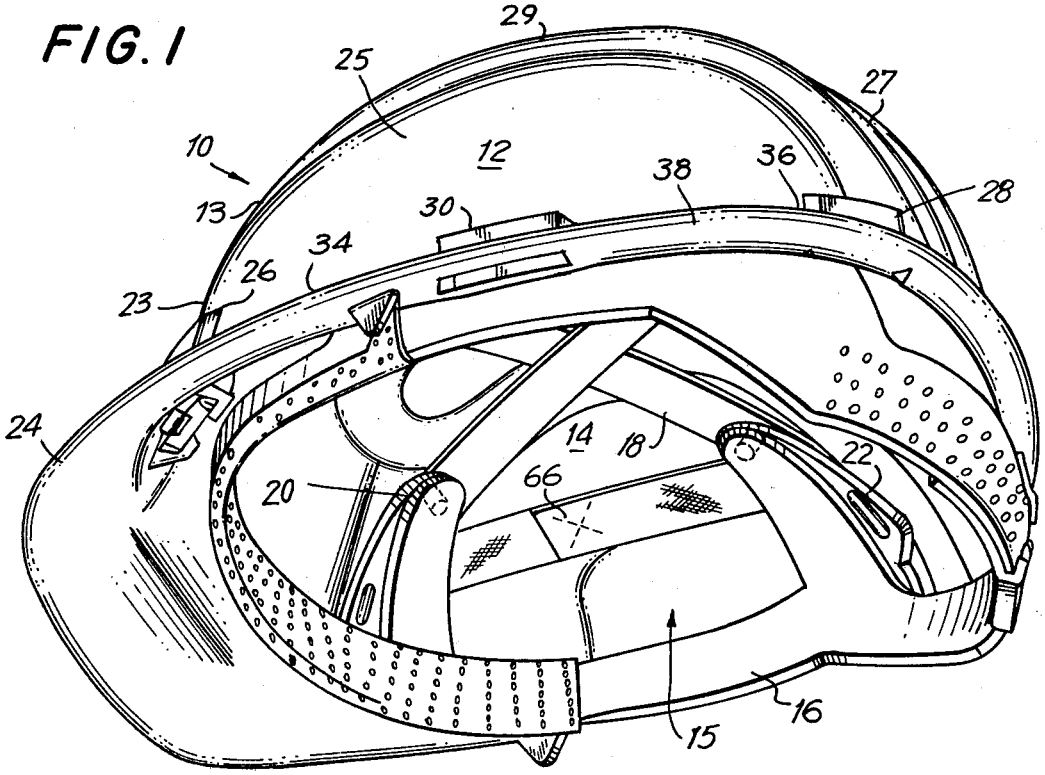
FIG. 1 is a perspective view of the protective helmet showing the underside of the shell with the suspension assembly.

Referring now in more detail to the drawings, in FIG. 1 a safety, or protective helmet 10 is shown in a perspective illustration. Helmet 10 comprises one-piece plactic shell 12, which includes approximately hemispherical casing 13 forming volume 14, and suspension assembly 15, which is suspended from shell 12 and which includes suspension body 16, webbing, or nylon suspension strap, 18, and two front mounting tabs 20 and two rear mounting tabs 22. Strap 18 and suspension body 16 are both connected to mounting tabs 20 and 22, only one of each of which can be seen in FIG. 1. Also indicated in FIG. 1 are front wall portion 23 and visor 24. Shell 12 forms two front tab recesses 26 and two rear tab recesses 28, one of each of which can be seen in FIG. 1. The exterior of chin strap connector slot 30 is also shown along one of side wall portions 25 which also has rear wall portion 27 and top wall portion 29.

Figure 2:
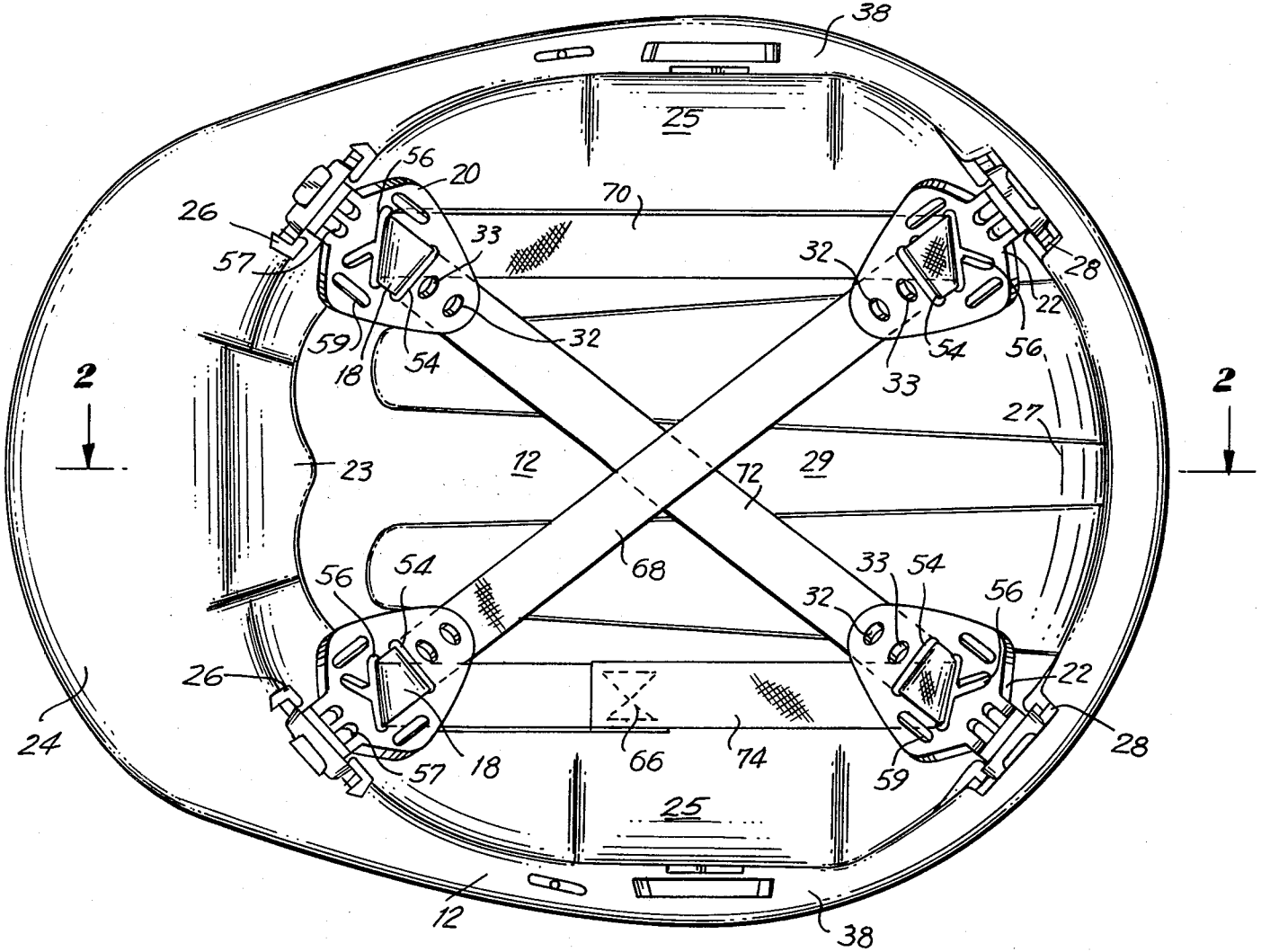
FIG. 2 is a bottom view of the shell with the strap assembly with the suspension body removed.

FIG. 2 illustrates a bottom view of helmet 10 with suspension body 16 removed. Body 16 is ordinarily suspended from the shell at the two front tabs 20 and the two rear tabs 22 at either tab mounting holes 32 or alternate holes 33, which are adapted to receive clip-on dowels (not shown) of the suspension body. FIG. 2 illustrates all four tabs and tab recesses, namely, front tabs and rear tabs 20 and 22 mounted in front and rear tab recesses 26 and 28 respectively, which are positioned on the front and rear portions 34 and 36 respectively of rim 38 of shell 12. The tab recesses are spaced relative to one another substantially on the plane of rim 38 and are positioned at the four corners of an imaginary rectangle on the plane, that is, the diagonal distances between front and rear tabs 20 and 22 are approximately equal.

Front tab recesses 26 are positioned relatively farther from rear tab recesses 28 than are front recesses 26 from one another and rear recesses 28 from one another. Front and rear tabs 20 and 22 mounted in the recesses follow the same pattern.

Figure 5:
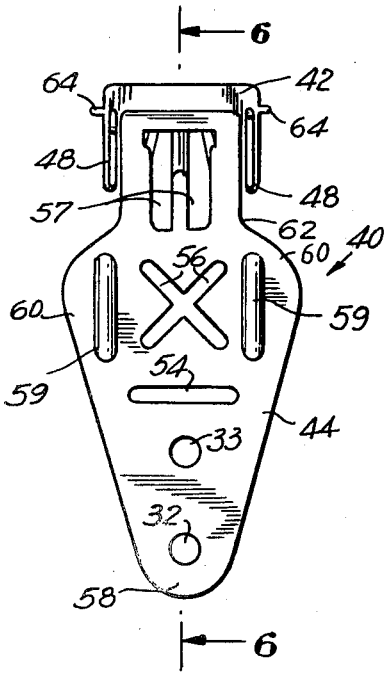
FIG. 5 is a side view of the tab taken through line 5—5 in FIG. 4.
Figure 6:
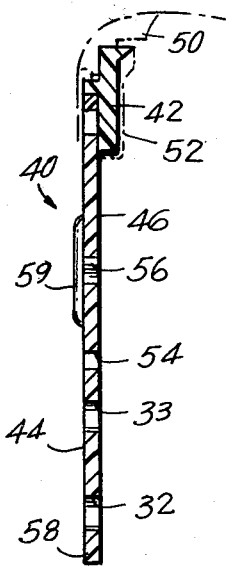
FIG. 6 is a rear view of the tab.
Figure 7:
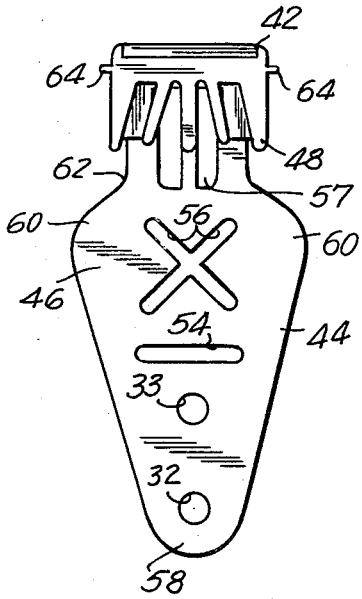

Front and rear tabs 20 and 22 are flexible and preferably are made of a polymer plastic. As illustrated in FIGS. 5, 6 and 7, a tab of the type of tab 20 and 22 comprises a tab body 40, including a mounting head 42 and an extended mounting member 44. As seen in the side view of FIG. 6, head 42 is connected to rearward surface 46 of substantially flat member 44. FIGS. 5 and 7 show head prongs 48 extending on each side of head 42. In positioning in the tab recesses, head 42 is inserted into selected expository recess 50 (FIG. 6) and prongs 48 slide downwards for positioning in mounting cavities 52 formed at opposite ends of recess 50. Recess 50 and one cavity 52 are schematically indicated in phantom lines in FIG. 6. Tab body 40 forms transverse single slot 54 so positioned on the tab that the slot is approximately parallel to the plane of rim 38. Slot 54 is adapted to receive strap 18. Tab body 40 also forms a pair of crossed slots 56 positioned between head 42 and single slot 54 spaced from each with the center of intersection between the slots being located approximately at the longitudinal center of tab body 40. Crossed slots 56 intersect one another at approximately 90 degrees and are in addition disposed relative to single slot 54 at an angle of approximately 45 degrees.

When tab head 42 is mounted in a selected expository recess 50, in particular in any of the front or rear tab recesses 26 or 28, head 42 is during use substantially on the down side and opposed tab end 58 is on the up side. Tab body 40 has extended side 60 to aid in holding down strap 18 when the strap is mounted to the tabs via single slot 54 and crossed slots 56 as will be discussed below. Body 40 also includes a pair of apertures 57 formed by the body and disposed on tab neck 62 between head 52 and crossed slots 56 for the purpose of adding flexibility to the tabs. As indicated earlier, each tab has at least one suspension body 16 mounting hole 32 and preferably alternate mounting hole 33. These holes are positioned between tab end 38 and single slot 54. The two holes are approximately at the longitudinal center of tab body 40. Two raised stiffeners 59 (FIG. 5) running longitudinally on each of tab extended sides 60 aid in strengthening the sides. A pair of catches 64 extend transversely from tab head 42 and contribute to keeping head 42 from lateral sliding in the recess.

As illustrated in FIG. 2 and looking up at the inner surface of top wall 29 of shell 12, strap 18 has been slidingly mounted to each of the four tabs and is connected to itself at its ends at strap joining position 66 preferably as indicated by the sewed "X" position. Picking up strap 18 from the point of joinder 66 and going toward front wall 23, strap 18 runs underneath the side of the tab body 40 of one of the front tabs 20 and then enters the cross slot of crossed slots 56 that directs strap 18 to the diagonal and passes over body 40 to single slot 54, where the strap passes under the body to tab end 58 where it emerges to first diagonal extension 68 to diagonally opposed proper rear tab 22 where it extends under body 40 to single slot 54 to the cross slot of crossed slots 56 that leads to the side of the shell and passes under the tab body unitl it emerges from the side of the body at first side extension 70. In the same manner the strap is mounted to the other of front tabs 20 and passes to second diagonal extension 72 to the other of rear tabs 22 where it runs to second side extension 74, where it is joined to itself at joining position 66.

Figure 3:
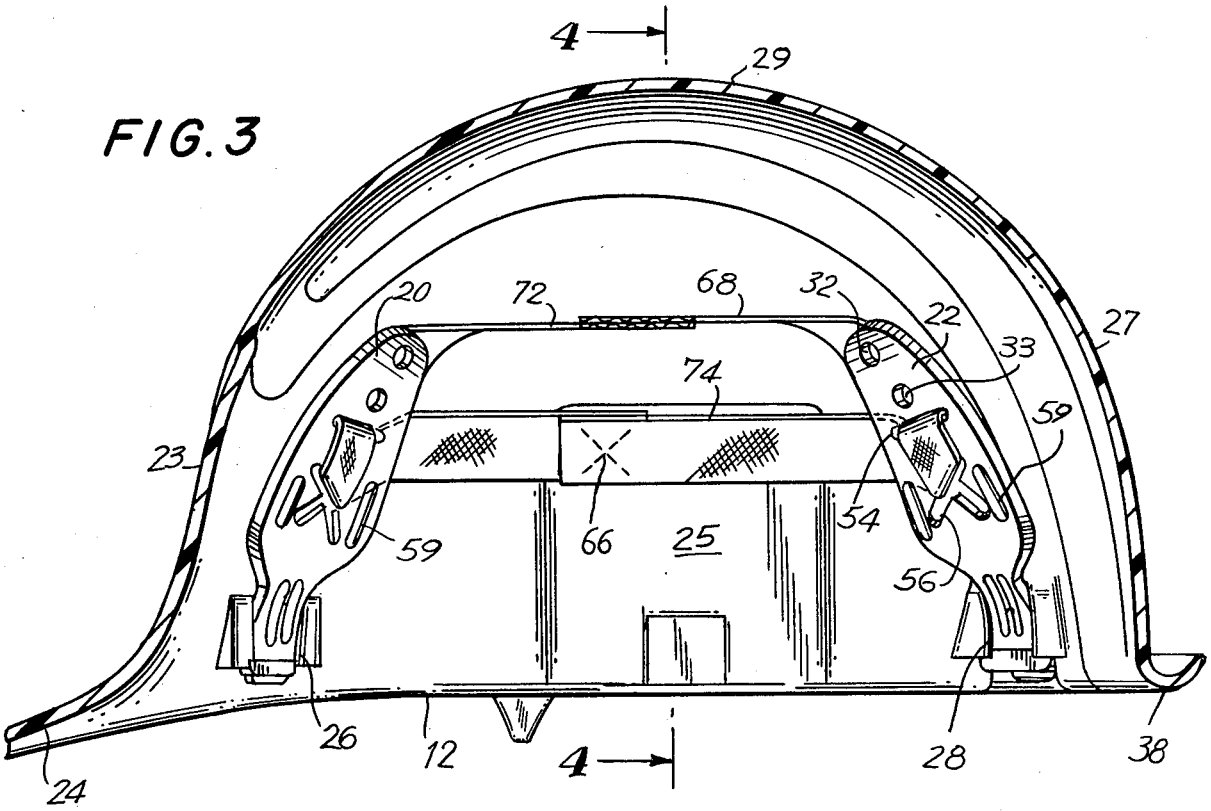
FIG. 3 is a side view of the shell and assembly taken through line 3—3 in FIG. 2.
Figure 4:
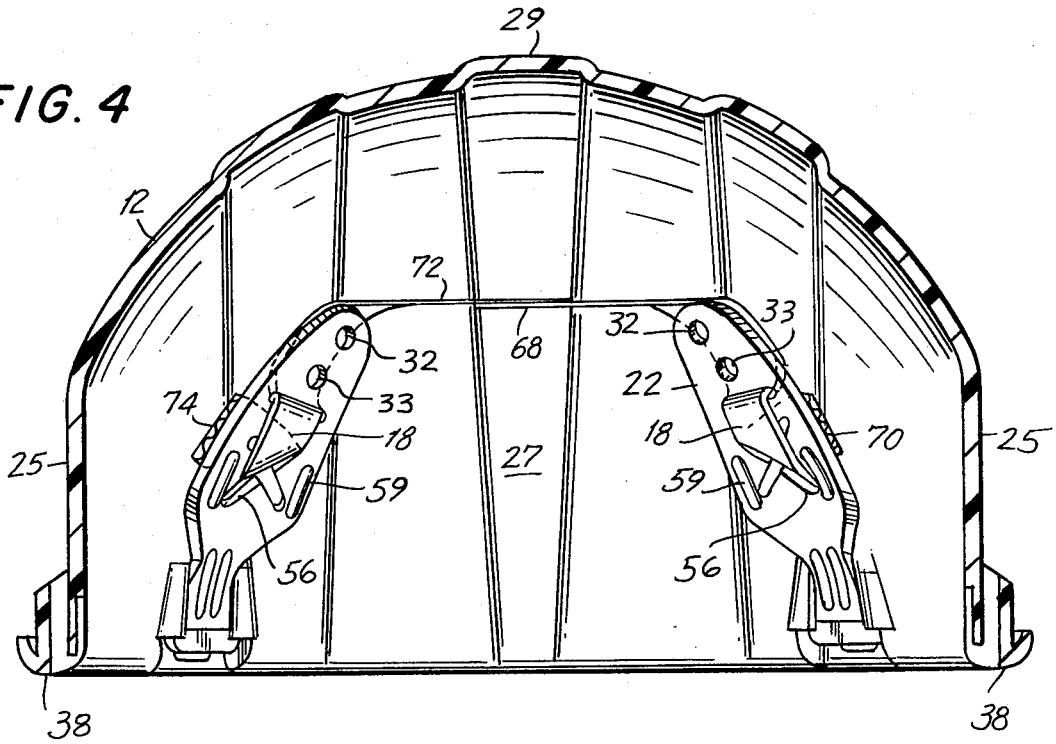
FIG. 4 is a front view of the tab.

From the side view illustration of FIG. 3 and front view illustration of FIG. 4, it can be seen that the first and second diagonal strap extensions 68 and 72 are extended slightly upwards into volume 14 of the shell by front tab 20 and rear tab 22 then are firmly extended diagonally to the diagonally opposite tabs. Sufficient play is left in strap 18 to allow adjusted upward or angular movements of the strap, particularly at the flexible tabs. Also, strap 18 is slidingly mounted in the tab slots, and play is allowed in the slots when the tabs are flexed one way or the other. The flats of strap 18 at diagonals 68 and 72 are substantially horizontal in the shell, and the flat of the strap is angled relative to both the vertical and horizontal at side extensions 70 and 74, as shown in front view in FIG. 4. In addition, diagonal extensions 68 and 72 are spaced nearer to top wall 29 of the shell than side extensions 70 and 74. Diagonal extensions 68 and 72 are substantially equal in distance. Also, side extensions 70 and 74 are also substantially equal in distance. Diagonals 68 and 72 are in spaced relationship to top wall 29 of the shell and side extensions 70 and 74 are in spaced relationship to side walls 25. In normal use the top wall of the shell is separated from the head of the wearer by diagonals 68 and 72 and in addition the novel invention separates the side walls from the head of the wearer by side extensions 70 and 74. In addition, the helmet protects the head of the wearer both vertically by the diagonals and laterally by the side extensions so that in the event of an impact against either top wall 29 on either of side walls 25 there is a distribution of impact forces over from strap extensions. Only the single strap joining connection 66 is subject to a joining failure.

The embodiment of the invention particularly disclosed and described hereinabove is presented merely as an example of the invention. Other embodiments, forms, and modifications of the invention coming within the proper scope and spirit of the appended claims will, of course, readily suggest themselves to those skilled in the art.

What is claimed is:

1. An improved suspension assembly for a protective helmet of the type having a plastic shell forming a volume having a rim, top wall, rear wall, front wall, and side wall portions and two front and rear tab recesses formed on the front and rear wall portions of the rim, the improvement, in combination, comprising:

flexible front and rear tab means mounted in each of said recesses, and strap means slidably mounted through said tab means, said strap means extending between said front and rear tab means over two equal diagonal distances and two equal side distances, said strap means at said diagonal distances being in spaced relationship from said top wall portion and at said side distances being in spaced relationship from said side wall portions, said strap means at said diagonal distances being disposed nearer to said top wall portion than said strap means at said side wall distance, said flexible tab means being for slidably mounting said strap means at said diagonal and side distances and for flexibly responding to vertical and lateral pressures;

said strap means being for flexibly resisting said vertical and lateral pressures, whereby the head of a user of the helmet is separated from the shell both vertically and laterally during normal and abnormal pressure occurrences.

2. An improved suspension assembly for a protective helmet according to claim 1, wherein said tab means includes:

a head portion, a flexible body connected to said head portion, said body forming a transverse slot and two perpendicularly crossed slots positioned between said head portion and said transverse slot, said crossed slots being positioned at equal angles relative to said transverse slot, said angles being approximately 45 degrees, said transverse and said crossed slots being adapted to receive said strap means.

3. An improved suspension assembly for a protective helmet according to claim 2, wherein said strap means is connected to each of said transverse slots and to one slot of each of said crossed slots.

4. An improved suspension assembly for a protective helmet according to claim 3, wherein said strap means is one strap having one connecting point.

5. An improved suspension assembly for a protective assembly according to claim 4, wherein said strap means has opposed flat surfaces and wherein at said diagonal distances one of said flat surfaces substantially faces said top wall portion and at said side distance one of said flat surfaces is disposed at an angle of said side wall portions, whereby the head of a wearer is protected both vertically and laterally by the flat of the strap means.

6. An improved strap assembly for a protective helmet according to claim 1, wherein said flexible body of said tab forms at least one aperture between said head portion and said crossed slots, whereby the flexibility of said body is enhanced.

7. An improved suspension assembly for a protective helmet according to claim 6, wherein said head portion includes catches extending transversely from said head portion, whereby said catches contribute to keeping said head from lateral sliding within said recess.

* * * * *